US005944559A

United States Patent [19]

Wu

[11] Patent Number: 5,944,559

[45] Date of Patent: Aug. 31, 1999

[54] SHIELDED ELECTRICAL CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 08/885,146

[22] Filed: Jun. 30, 1997

[30] Foreign Application Priority Data

| | | | |
|---|---|---|---|
| Jun. 29, 1996 | [TW] | Taiwan | 85209862 |
| Jun. 29, 1996 | [TW] | Taiwan | 85209863 |
| Jun. 29, 1996 | [TW] | Taiwan | 85209864 |
| Jun. 29, 1996 | [TW] | Taiwan | 85209865 |

[51] Int. Cl.[6] ..... H01R 13/648

[52] U.S. Cl. ..... 439/607

[58] Field of Search ..... 439/607–610, 439/692

[56] References Cited

U.S. PATENT DOCUMENTS

| | | | |
|---|---|---|---|
| 5,518,421 | 5/1996 | Davis | 439/607 |
| 5,564,949 | 10/1996 | Wellinsky | 439/607 |
| 5,605,469 | 2/1997 | Wellinsky et al. | 439/607 |
| 5,683,269 | 11/1997 | Davis et al. | 439/607 |

*Primary Examiner*—Hien Vu

[57] ABSTRACT

An electrical connector comprises an elongate insulating housing including a plurality of first and second passageways, a central cavity recessed on a rear surface communicating the passageways for mating a mating electrical connector and a plurality of conductive contacts received in the first and second passageways for transmitting signals and for supplying power, respectively. The central cavity comprises separation walls for prevention of undesired conductive contacting between the conductive contacts. The passageways include an open space extending a various depth from a front surface of the insulating housing and communicating at least one adjacent open space. A wall is provided between each adjacent pair of the open spaces for at least partially separating the adjacent pair of open spaces. A metal shell is provided for prevention of electromagnetic interference and a metal cap is provided for mechanically connecting with a cable. The conductive contacts received in the passageways may be attached to a cable by the processes of crimping, soldering and/or insulation displacement conductive contact.

14 Claims, 12 Drawing Sheets

FGI. 6C

FGI. 8A

FGI. 9C

SHIELDED ELECTRICAL CONNECTOR

BACKGROUND OF THE INVENTION

1. Field of The Invention

The invention relates to an electrical connector, particularly to a Universal Serial Bus (USB) connector having shielding device.

2. The Prior Art

There is a trend in the computer field to use USB connectors in place of most of the I/O connectors, such as D-Sub connectors and Mini-Dins. An I/O connector disclosed in U.S. Pat. No. 4,516,822 is shown in FIG. 1. This I/O connector has the problems that there is a poor electrical contact effect between the cable conductors and the contacts of the connector. In addition, the cable is secured by plastic structure, which provides a poor securing to the cable. Moreover, no metal shielding device is provided for prevention of electromagnetic interference and for grounding.

A number of electrical connectors having a metal shielding device were proposed to solve the above-mentioned problems, such as the two disclosed in U.S. Pat. Nos. 5,073,130 shown in FIG. 2 and 5,267,822 shown in FIG. 3. These connectors, however, still have the shortcomings that the structures involved are very complex, which not only raises level of difficulty in manufacturing and assembling, but also causes inconvenience in mechanical and electrical connections between the cable conductors and the contacts of the connector. Furthermore, the means for securing the cable is poor.

In addition, a number of electrical connectors having similar structure to those mentioned above were proposed in, for example, Taiwan Patent Application Nos. 81300211 and 81217896 and U.S. Pat. Nos. 5,013,262 and 5,017,156, while the above-mentioned problems and shortcomings still remain unsolved.

Hence, there is a need for a shielded electrical connector that can overcome the above-mentioned problems and shortcomings.

SUMMARY OF THE INVENTION

Accordingly, one object of the present invention is to provide a USB connector having a shielding device.

Another object of the present invention is to provide a USB connector having excellent electrical connection between the cable conductors and the contacts of the connector.

Still another object of the present invention is to provide a USB connector having excellent mechanical connection the cable.

One more object of the present invention is to provide a USB connector which is easy to manufacture and assemble.

To fulfill the above-mentioned objects, according to one preferred embodiment of the present invention, an electrical connector comprises an elongate insulating housing including a plurality of first and second passageways extending longitudinally therein, a central cavity recessed on a rear surface thereof communicating the first and second passageways for mating a mating connector; and a plurality of first and second conductive contacts received in the first and second passageways and extending into the central cavity for transmitting signals and for supplying power, respectively. The central cavity comprises at least one separation wall raised from an inner lateral surface thereof for prevention of undesired contacting between the contacts. Each of the first and second passageways further includes an open space extending a depth from a front surface of the housing toward the rear surface of the housing and communicating at least one adjacent open space, the extending depth of each of the open spaces being different from that of at least one adjacent open space for facilitating mounting of the contacts into the passageways. A wall is provided between each adjacent pair of the open spaces for at least partially separating the adjacent pair of open spaces.

In another preferred embodiment, the present electrical connector further comprises a metal shell surrounding the housing for prevention of electromagnetic interference and a metal cap mounted on a front end of the housing for mechanically connecting with a cable.

In one aspect, the shielding device according to the present invention comprises a metal shell defining an elongate through chamber therein for receiving a housing for an electrical connector; and a metal cap including a main plate defining an opening on a central portion thereof for passing of a cable, and a first and a second deflected plate having clipping means for clipping each other to clamp the cable; and latching means for latchably connecting the metal cap to the metal shell. In one preferred embodiment, the shielding device comprises a metal shell defining an elongate through chamber therein for receiving a housing for an electrical connector and at least one longitudinal plate extending inward from an inner surface thereof for positioning into the housing. The metal shell includes a front section and a rear section of different cross section from the front section, and the at least one longitudinal plate is formed on the rear section.

In one aspect, the conductive contact according to the present invention comprises a base plate, a tail plate extending from a rear portion of the base plate, and fastening means for fastening onto a passageway of a housing for a connector; the base plate including a first attachment portion near a front edge and a second attachment portion near the tail plate whereby a cable conductor may be attached to the base plate by any of the following processes: crimping, soldering and insulation displacement contact.

These and additional objects, features, and advantages of the present invention will be apparent from a reading of the following detailed description of the embodiments of the invention taken in conjunction with the appended drawing figures, which are described briefly immediately below.

BRIEF DESCRIPTION OF THE DRAWINGS

FIGS. 6C and 6D show perspective views of another two embodiments of the conductive contacts used in the USB connector shown in FIG. 4;

FIGS. 8A and 8B show a front and a rear perspective view of the metal shell used in the USB connector shown in FIG. 4;

FIGS. 9A–9D show different stages of assembling of the present USB connector.

DETAILED DESCRIPTION OF THE PREFERRED EMBODIMENTS

Figure 1:
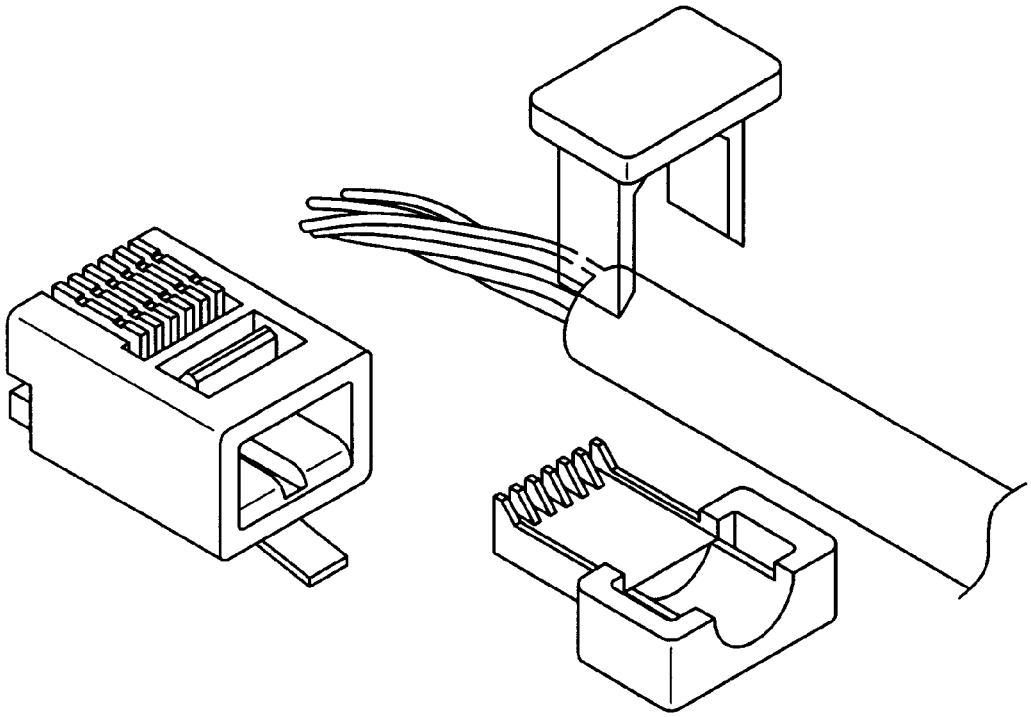
FIG. 1 (PRIOR ART)
FIG. 1 is an exploded perspective view of a conventional I/O connector without a shielding device.
Figure 2:
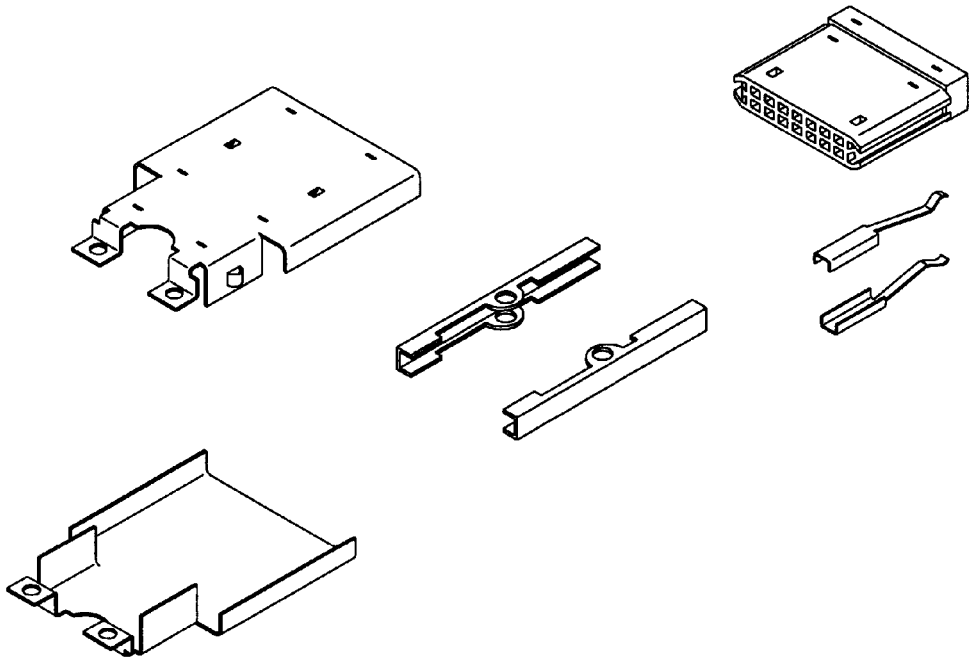
FIG. 2 (PRIOR ART)
FIG. 2 is an exploded perspective view of a conventional I/O connector including a shielding device.
Figure 3:
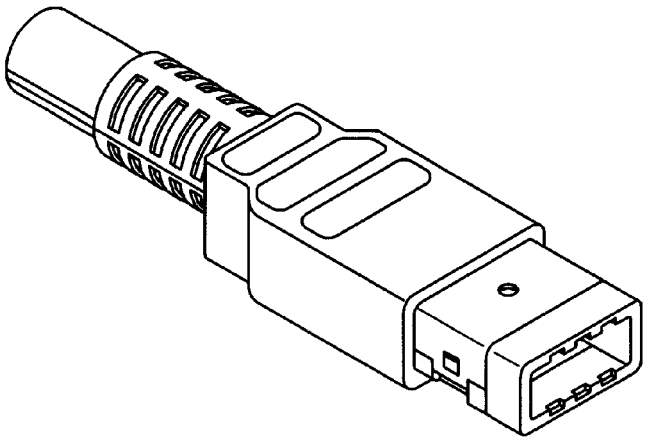
FIG. 3 (PRIOR ART)
FIG. 3 is an assembled perspective view of another conventional I/O connector including a shielding device.

Reference will now be made in detail to the preferred embodiments of the present invention. It will be noted here that for a better understanding, most of like components are designated by like reference numerals throughout the various figures in the embodiments.

Figure 4:
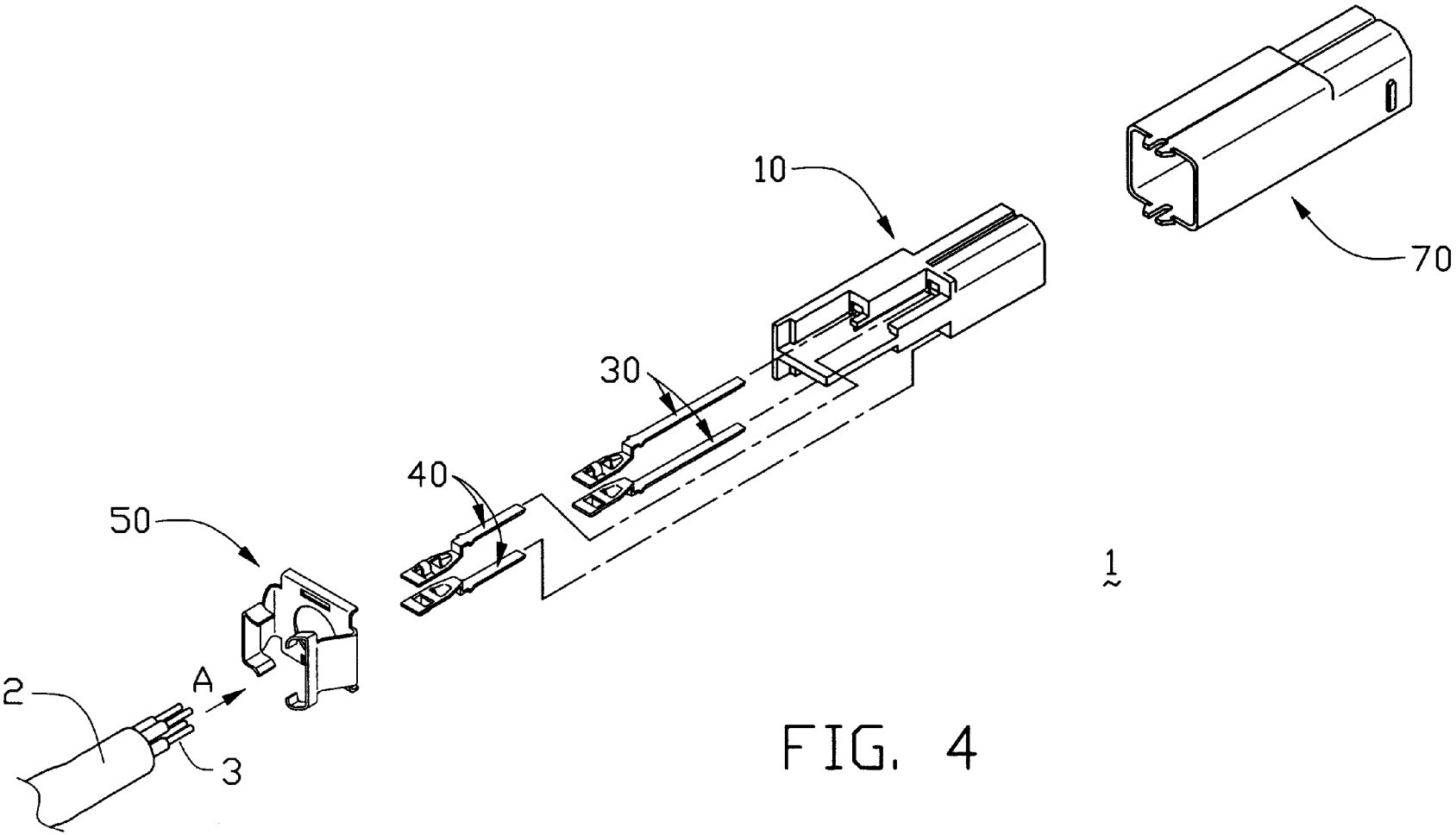
FIG. 4 is an exploded perspective view of a USB connector according to one preferred embodiment of the present invention.

Referring now to FIG. 4, an exploded view of a shielded USB electrical connector according to one preferred embodiment of the present invention is generally designated at 1. The connector 1 mainly comprises an elongate insulating housing 10, a pair of long, first conductive contacts 30, a pair of short, second conductive contacts 40, a metal cap 50 and an elongate metal shell 70. The metal shell 70 together with the metal cap 50 forms an excellent shielding device for prevention of external electromagnetic interference. In one preferred embodiment, the long pair of contacts 30 are symmetrically disposed in the housing 10, and so do the short pair of contacts 40. A cable 2 is inserted into the connector 1 through an opening 52 (see FIGS. 7A and 7B) on the metal cap 50, which will be described in detail hereinafter.

Figure 5A:
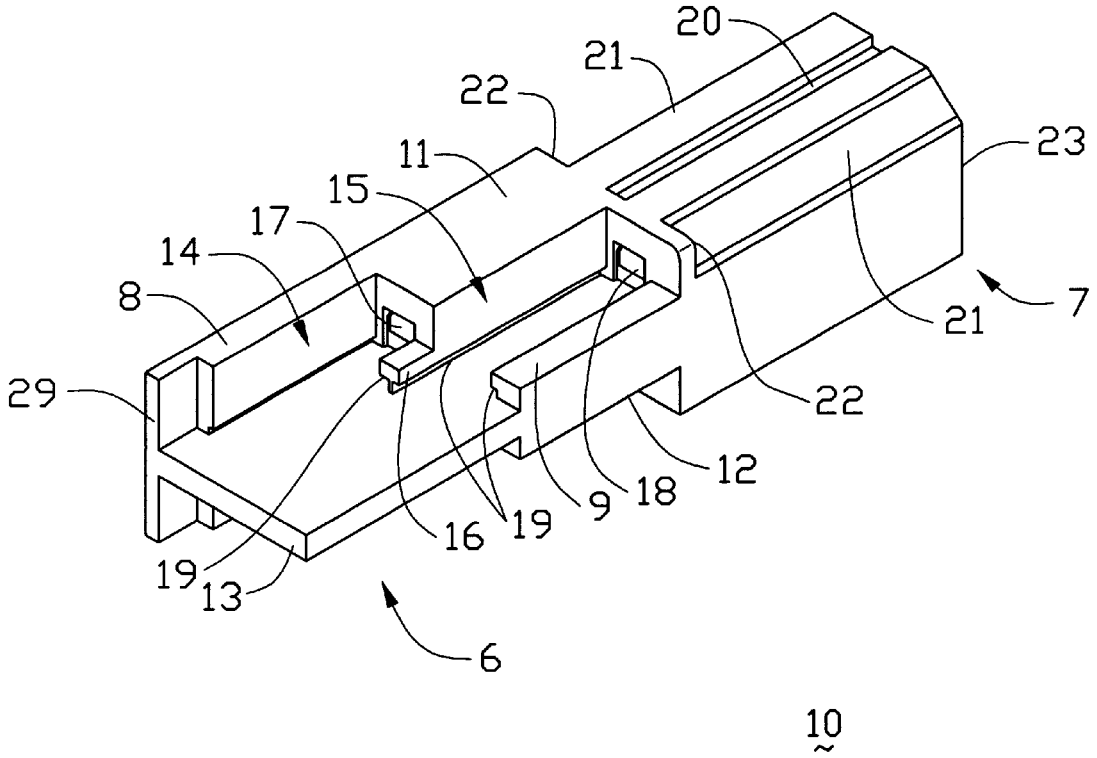
FIGS. 5A–5C show perspective views from different orientation of the insulating housing used in the USB connector shown in FIG. 4.
Figure 5B:
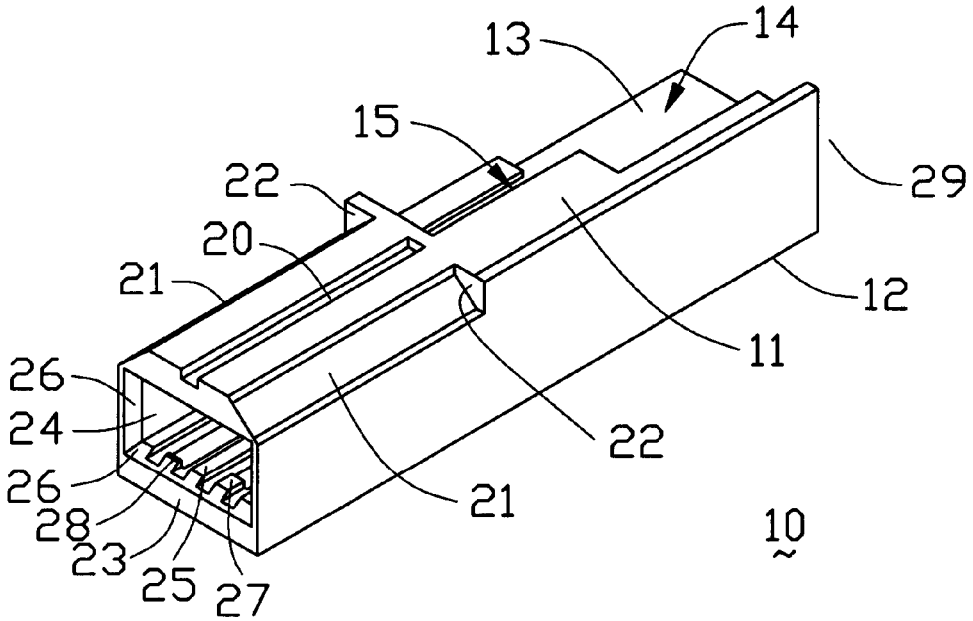
Figure 5C:
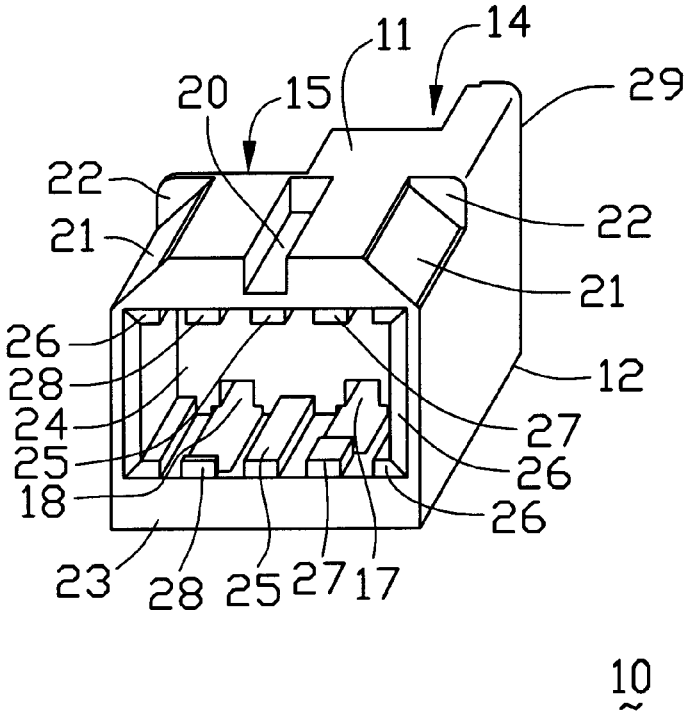

Also refer to FIGS. 5A–5C, showing therein perspective views from different orientation of the insulating housing 10 of the USB connector 1. FIG. 5 shows a front perspective view of the insulating housing 10, wherein the housing 10 comprises a front section 6 and a rear section 7. The front section 6 includes an upper portion 11, a lower portion 12 and a central floor 13 extending longitudinally between the upper and the lower portions 11, 12. In the present embodiment, the upper and the lower portions 11, 12 of the front section 6 are symmetric relative to the central floor 13, and thus only the upper portion 11 will be described hereinafter.

The upper portion 11 defines a first open space 14 extending longitudinally from a front surface 29 of the housing 10 to a middle position of the upper portion 11, a second open space 15 extending longitudinally from the front surface 29 to a rear position of the front section 6 and adjacent to and open to the first space 14, a middle wall 16 extending form the middle position into between the first and the second space 14, 15, and a pair of outside walls 8, 9 extending upward from the central floor 13. An open space here refers to a space defined by at least two walls and has at least two sides at least partially open to other spaces. The extending depth of the first open space 14 from the front surface 29 is thus shorter than that of the second open space 15 for facilitating mounting of the contacts into the passageways.

A passageway 17 is formed in the upper portion 11 extending from the first open space 14 to a rear surface 23 of the housing 10 for receiving a long contact 30. A pair of lateral slots 19 are formed on an inner surface of the outside wall 8 and the central wall 16 for guiding entering of the long contact 30 and restricting a longitudinal motion of the contact 30 relative to the housing 10. Similar, a passageway 18 is formed in the upper portion 11 extending from the second open space 15 to the rear surface 23 for receiving a short contact 40, and a pair of lateral slots 19 are formed on an inner surface of the outside wall 9 and the central wall 16 for the same purposes.

The rear section 7 of the housing 10 comprises a central cavity 24 formed on the rear surface 23 communicating the passageways 17, 18 for receiving a mating electrical connector (not shown). The cavity 24 comprises a pair of separation walls 25 raised from an top and a bottom surfaces thereof and extending from the rear surface 23 to an inner most wall of the cavity 24 for prevention of undesired contacting between the long contact 30 and the short contact 40.

The cavity 24 further comprises a long and a short protrusion 27, 28 formed on both sides of each of the separation walls 25. The short pair of protrusions 27 raise from the top and the bottom surfaces of the cavity 24, extending from the rear surface 23 toward the inner most surface of the cavity 24 a short distance, and aligning with the passageways 17. Similarly, the long pair of protrusions 28 raise from the top and the bottom surfaces of the cavity 24, extending from the rear surface 23 toward the inner most surface of the cavity 24 a long distance, and aligning with the passageways 18.

In one embodiment, the separation wall 25 is formed on a central position as a central separation wall 25. In another embodiment, the separation wall 25 and the long and short contacts 30, 40 on the top surface of the cavity 24 are symmetric to those on the bottom surface of the cavity 24.

The cavity 24 is chamfered to form an annular chamfer surface 26 adjacent to the rear surface 23 to facilitate insertion of a mating electrical connector.

The rear section 7 further comprises a central groove 20 formed on its top surface and extending longitudinally from the rear surface 23, and a pair of chamfers 21 formed on two lateral corners thereof extending longitudinally from the rear surface 23 and stop at a pair of stoppers 22 formed adjacent to the front section 6. The groove 20, chamfers 21 and stoppers 22 are configured to match with the metal shell 70, which will be described in detail hereinafter. In one embodiment, the outer profile of the rear section 7 is symmetric relative to the central groove 20.

Figure 6A:
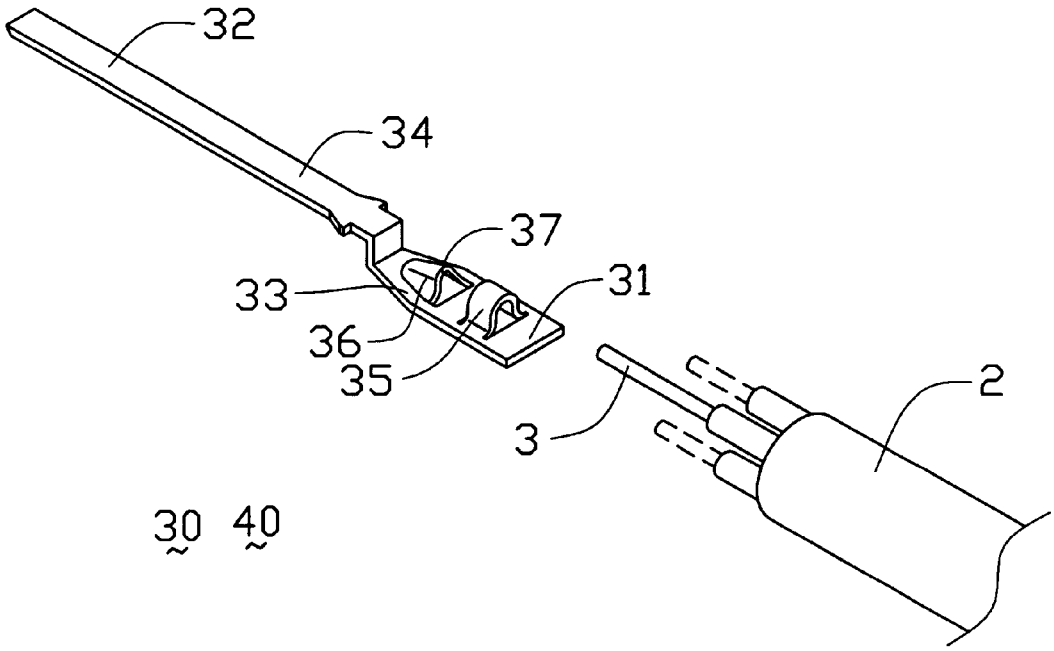
FIG. 6A shows a perspective view of the conductive contact used in the USB connector shown in FIG. 4.

Referring now to FIG. 6A, a conductive contact used in the present USB connector is shown. The conductive contact can be a long contact 30 or a short contact 40, depending on the length of a tail portion 32 of the contact, and thus only contact 30 is described hereinafter. The contact 30 is substantially an elongate plate, comprising a base plate 31 and a tail plate 32 extending from a tapered rear portion 33 of the base plate 31. The tail plate 32 bends upward substantially at right angle from the tapered portion 33 and then bends rearward at substantially right angle.

The tail plate 32 includes fastening means 34 near the tapered portion 33 for fastening onto the passageway 17. In one embodiment, the fastening means 34 comprising a pair of barbs on both edges of the tail plate 32 for interferencingly fitting with an inner wall of the passageway 17.

The base plate 31 includes an inverted U-shaped first attachment portion 35 near its front edge, a semi-conic second attachment portion 36 near the tail plate 32, and a plane third attachment portion 37 between the first and the second attachment portions 35, 36. The inverted U-shaped attachment portion 35 has its two ends connected to the base plate 31, forming a tunnel for passing a conductor 3 of the cable 2. The semi-conic attachment portion 36 has its enlarged end opened and facing forward for receiving a conductor 3 passing through the inverted U-shaped attachment portion 35 and the plane attachment portion 37. The conductor 3 passing through the tunnel of the first attachment portion 35 may be attached to the contact 30 by crimping the first attachment portion 35, or by first inserting into the second attachment portion 36 and then crimping the second attachment portion 36, or by soldering onto the third attachment 37, or, by any combination of these processes. In one embodiment, the first and second attachment portions 35, 36 are stamped from the base plate 35, forming a plane third attachment portion 37 therebetween.

Figure 6B:
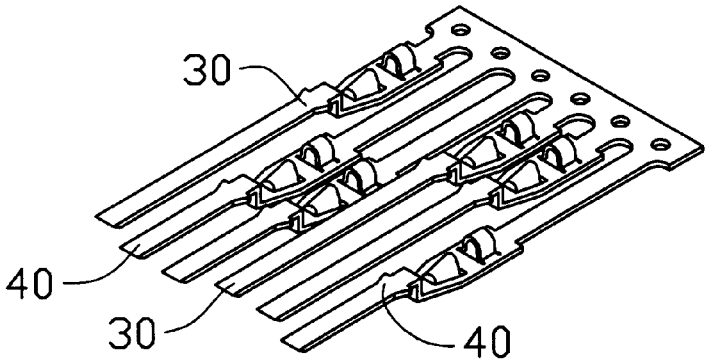
FIG. 6B shows the arrangement of long and short conductive contacts on a carrier.

FIG. 6B shows the arrangement of the long and short conductive contacts 30, 40 on a carrier. It can be seen that, two long contacts 30 and two short contacts 40 are alternatively stamped on a metal strip. In this arrangement, two adjacent long and short contacts 30, 40 on the carrier can be inserted into the first and second passageways 17, 18 on the upper portion 11 at the same time, and then another two adjacent short and long contacts 40, 30 on the carrier can be inserted into the second and first passageways 18, 17 on the lower portion 12 at the same time. Therefore, only two operations are required to mount all the four contacts 30, 40 onto a housing 10.

Figure 6D:
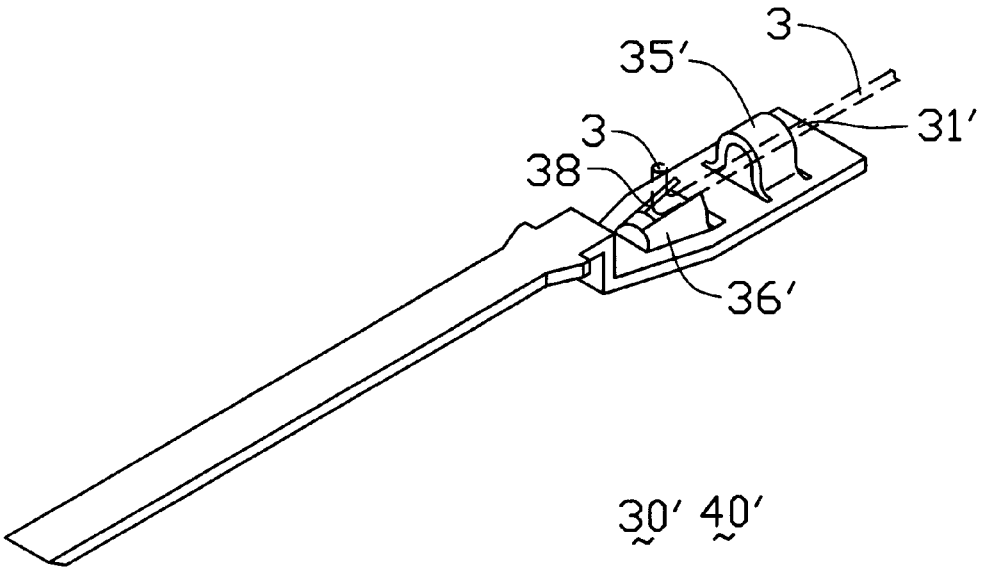
Figure 6D:
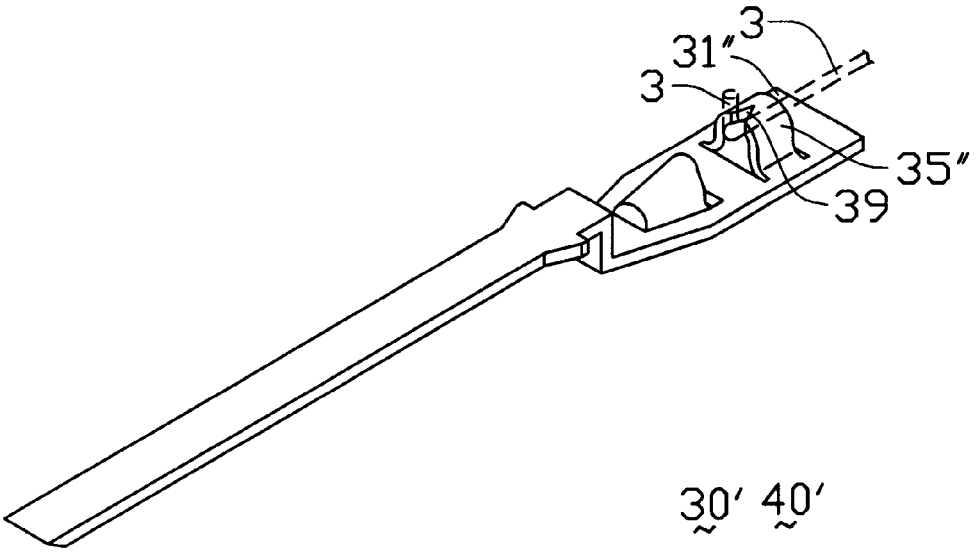

FIGS. 6C and 6D show another two embodiments of the present conductive contacts. As mentioned previously, the conductive contacts can be long contacts 30' and 30" or short contacts 40' and 40", and the only difference between the long and short contacts is the length of a tail portion thereof, and thus only contacts 30' in FIG. 6C and 30" in FIG. 6D will be described. In the embodiment shown in FIG. 6C, the semi-conic attachment portion 36' has a notch 38 on an upper front edge thereof and the notch 38 has a sharp edge for electrical connection with the conductor 3 by insulation displacement contact (IDC). In the embodiment shown in FIG. 6D, the inverted U-shaped attachment portion 35" has a notch 39 on the upper rear edge thereof and the notch 39 has a sharp edge for electrical connection with the conductor 3 by insulation displacement contact (IDC).

Figure 7A:
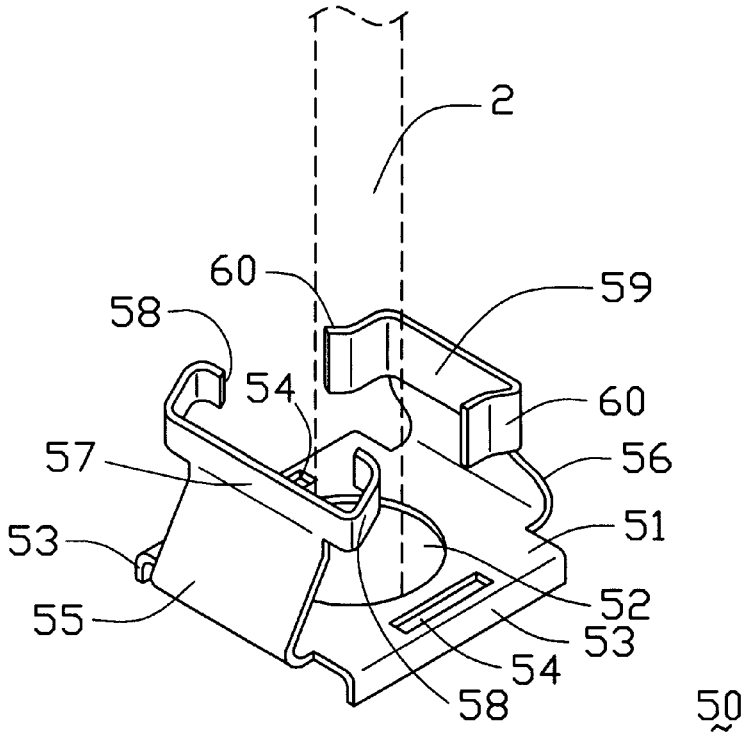
FIGS. 7A and 7B show perspective views of the metal cap used in the USB connector shown in FIG. 4 before and after the first and the second clips clamp the cable.
Figure 7B:
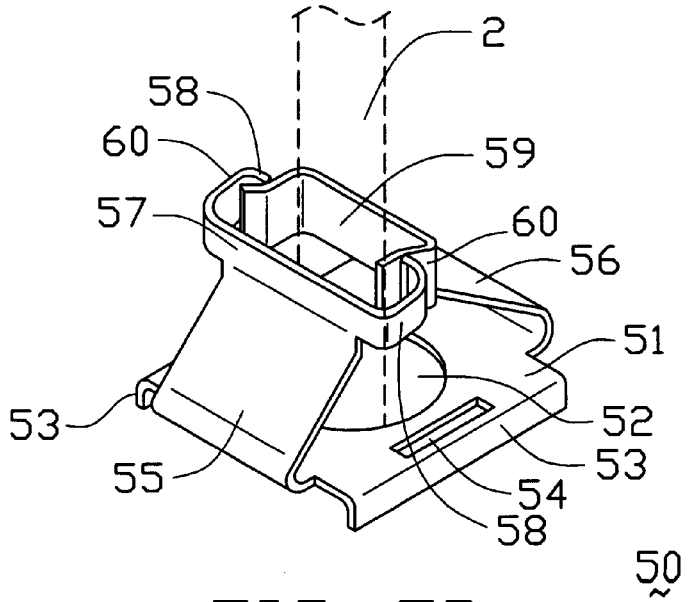

Please refer to FIGS. 7A and 7B, the metal cap 50 is shown in detail, before and after a cable 2 is clamped by the first and the second clips 57, 58. The metal cap 50 comprises a substantially square main plate 51, a circular opening 52 formed on a center portion of the main plate 51, a pair of abutment plates 53 extending downward from two opposite edges of the main plate 51, and a first and a second deflected plate 55, 56 extending upward and inward from the other two opposite edges of the main plate 51. The deflected plates 55, 56 include a first and a second clips 57, 59, respectively. The first clip 57 includes a pair of hook plates 58 on both lateral sides thereof for engaging a pair of concave plates 60 on both lateral sides of the second clip 59. A slit 54 is provided near each of the abutment plates 53 for latchably engaging a latch 72 of the metal shell 70. In one preferred embodiment, the metal cap 50 may be formed by stamping and bending as a unitary piece.

Figure 8B:
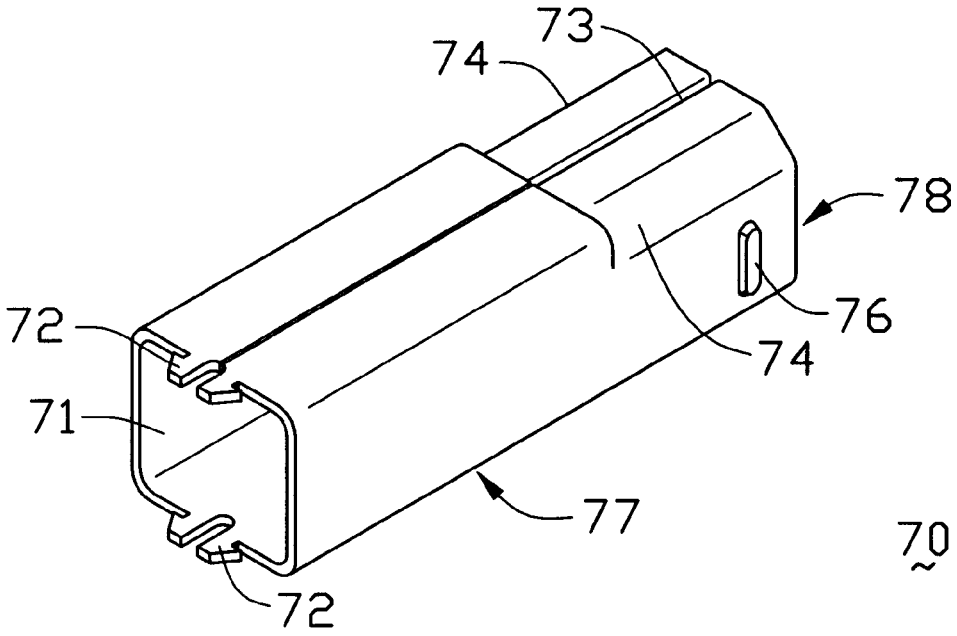
Figure 8B:
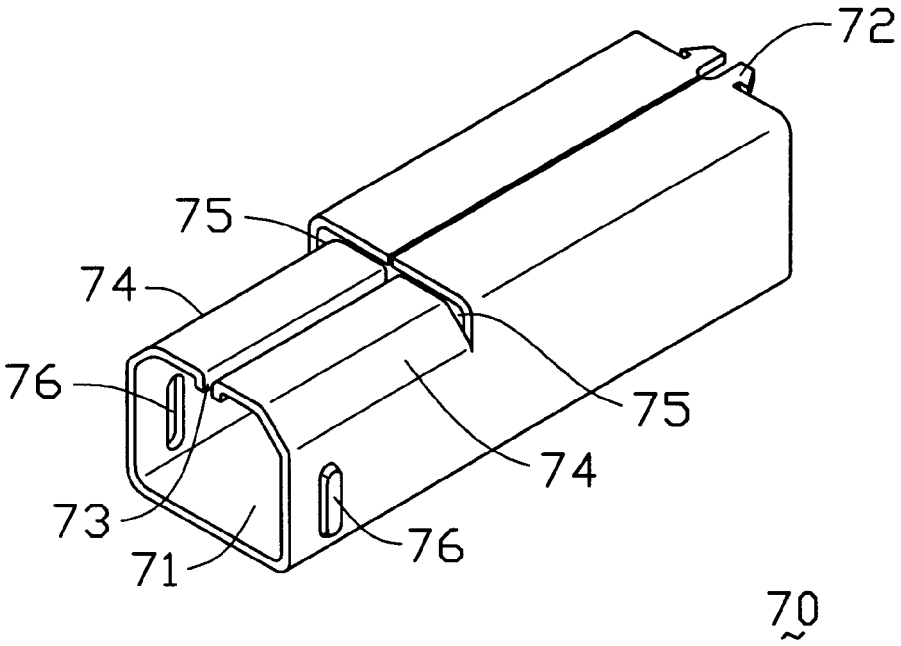

Please refer to FIGS. 8A and 8B, the metal shell 70 is shown in detail. The metal shell 70 includes a front section 77 of substantially square cross section and a rear section 78 conforming to the rear section 7 of the housing 10, and defines an elongate through chamber 71 therein for receiving the housing 10.

The front section 77 of the shell 70 includes a pair of latch 72 extending forward from a pair of opposite front edges for latchably engaging into the slits 54 of the metal cap 50. The rear section 78 includes a pair of longitudinal positioning plates 73 adjacent to each other extending downward from an inner upper surface thereof for inserting into the central groove 20 of the housing 10. The rear section 78 further includes a pair of slant surfaces 74 along the two lateral corners thereof, extending longitudinally from the rear end of the rear section 78 and stopping at a pair of abutment edges 75 adjacent to rear edges of the front section 77. The slant surfaces 74 and the abutment edges 75 are configured to match the chamfers 21 and stoppers 22 of the housing 10. The rear section 78 further comprises a pair of embossments 76 formed on lateral sides thereof for engaging with a mating connector.

Though the latch 72 shown in FIGS. 8A and 8B includes hooks for latchably engaging the slit 54 of the metal cap 50, in one embodiment, the latch can be one without hooks but rather a plane plate (not shown) for latching the slit 54 by passing therethrough and then bending.

In one preferred embodiment, the metal shell 70 may be formed by stamping and bending a plate as a unitary piece and the pair of longitudinal positioning plates 73 are the edge portions of the plate.

Figure 9A:
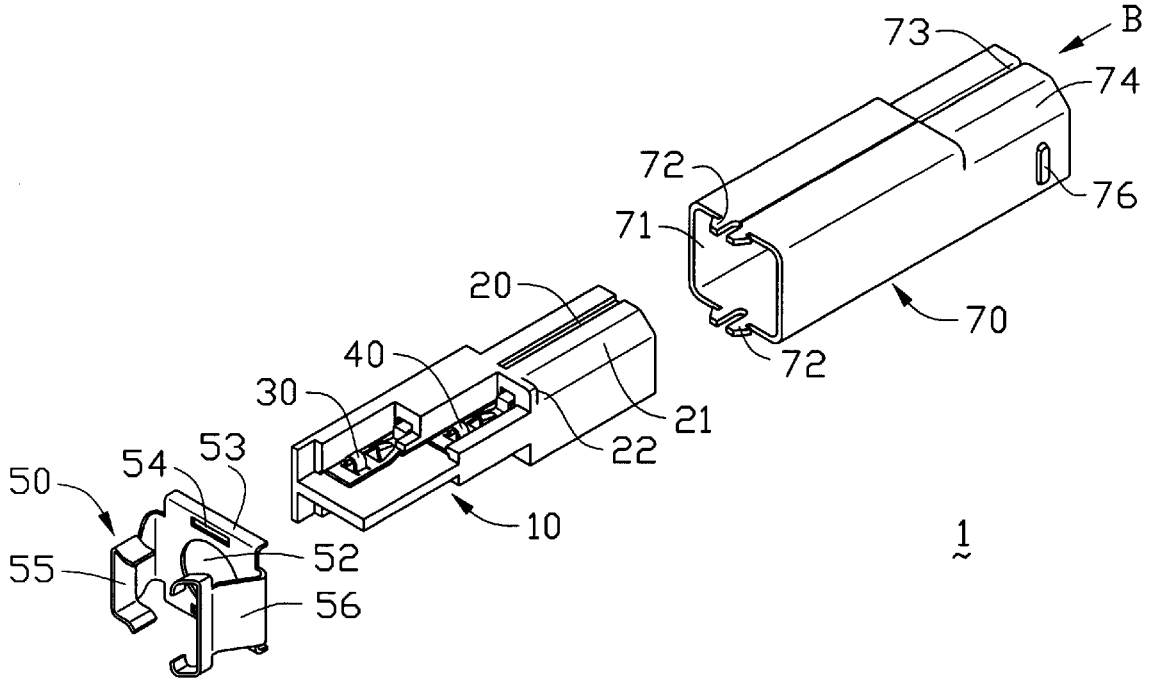

Please refer to FIGS. 9A–9D, successive assembling stages of the present USB connector are shown therein. As shown in FIG. 9A, first, the contacts 30, 40 are mounted onto the housing 10. When inserted into the passageway 17, the tail section 32 of the long contact 30 extends into the passageway 17 from the open space 14 and the base section 31 is guided at its edges by the slots 19 formed on the walls 7, 16. After further advancing, the tip of the tail section 32 will finally abut on the long protrusion 27 in the cavity 24. With the same procedure, a short contact 40 will be mounted into the passageway 18 at the same time, with the tip of the tail section 32 abutting on the short protrusion 28. The conductors 3 of the cable 2 are then attached onto the base section 31 of the contacts 30, 40 by the processes mentioned previously after extending through the opening 52 of the metal cap 50 in the direction shown by arrow A of FIG. 4.

Figure 9B:
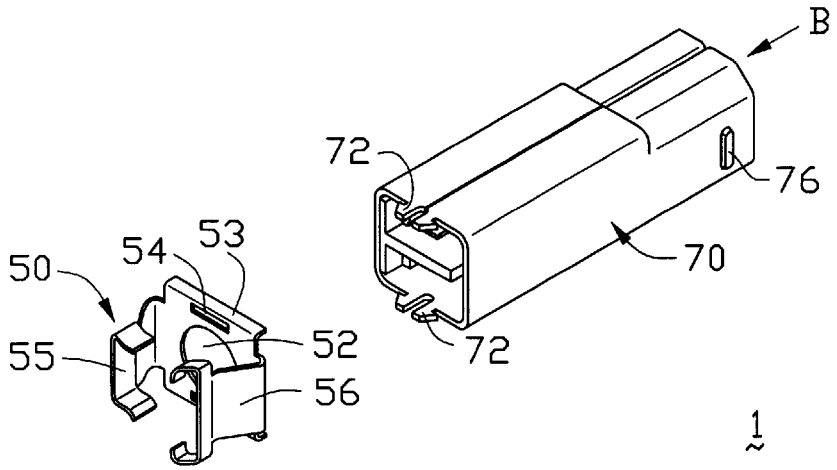

Next, the metal shell 70 is mounted onto the housing 10 in the direction shown by arrow B of FIG. 9B. After the front section 77 of the metal shell 70 passes the rear section 7 of the housing 10, the rear section 78 of the metal shell 70 enters the rear section 78 with the positioning plates 73 guided by the groove 20 and the slant surfaces 74 sliding on the chamfers 21 until the abutment edges 75 of the metal shell 70 are stopped by the stopper 22 of the housing 10. The housing 10 is now completely received in the metal shell 70.

As can be seen in FIG. 9C, the metal cap 50 is then capped onto the front surface of the housing 10 with the latches 72 of the metal shell 70 latchably engaging into the slits 54 and the abutment plates 53 abutting on front portions of the shell 70. The metal shell 70 and the metal cap 50 now cooperate to form an excellent shielding device for prevention of external electromagnetic interference, completely surrounding the housing 10 except for the rear surface 23 for mating a mating connector.

Figure 9D:
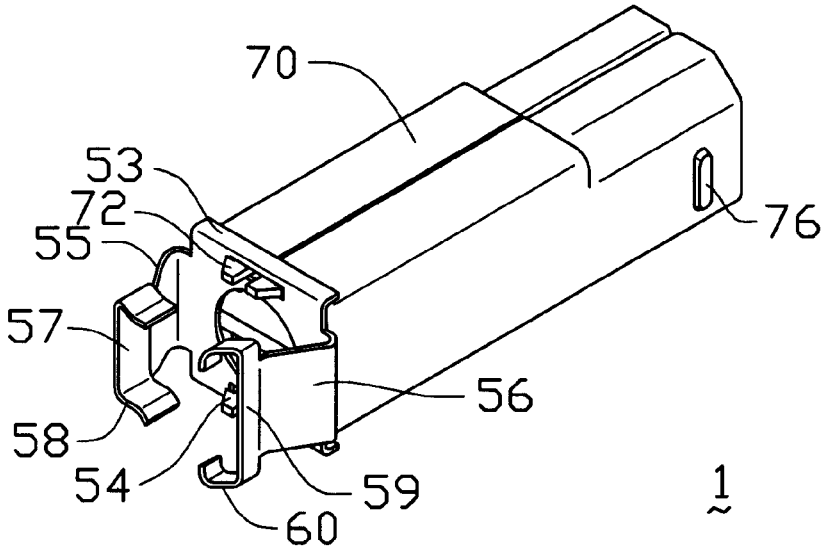
Figure 9D:
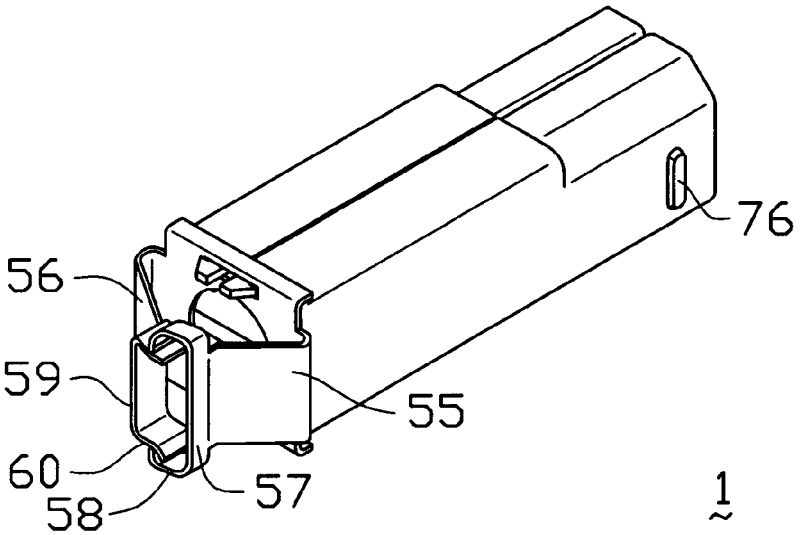

Finally, the first and second deflected plates 55, 56 are bent to each other so that the first and second clips 57, 59 clamp the cable 2 and then the pair of hook plates 58 of the first plate 57 securely engage the pair of concave plates 60 of the second clip 59, as shown in FIG. 9D. The first and second clip 57, 59 can be further crimped to enhance the clamping effect thereof (not shown).

Figure 10:
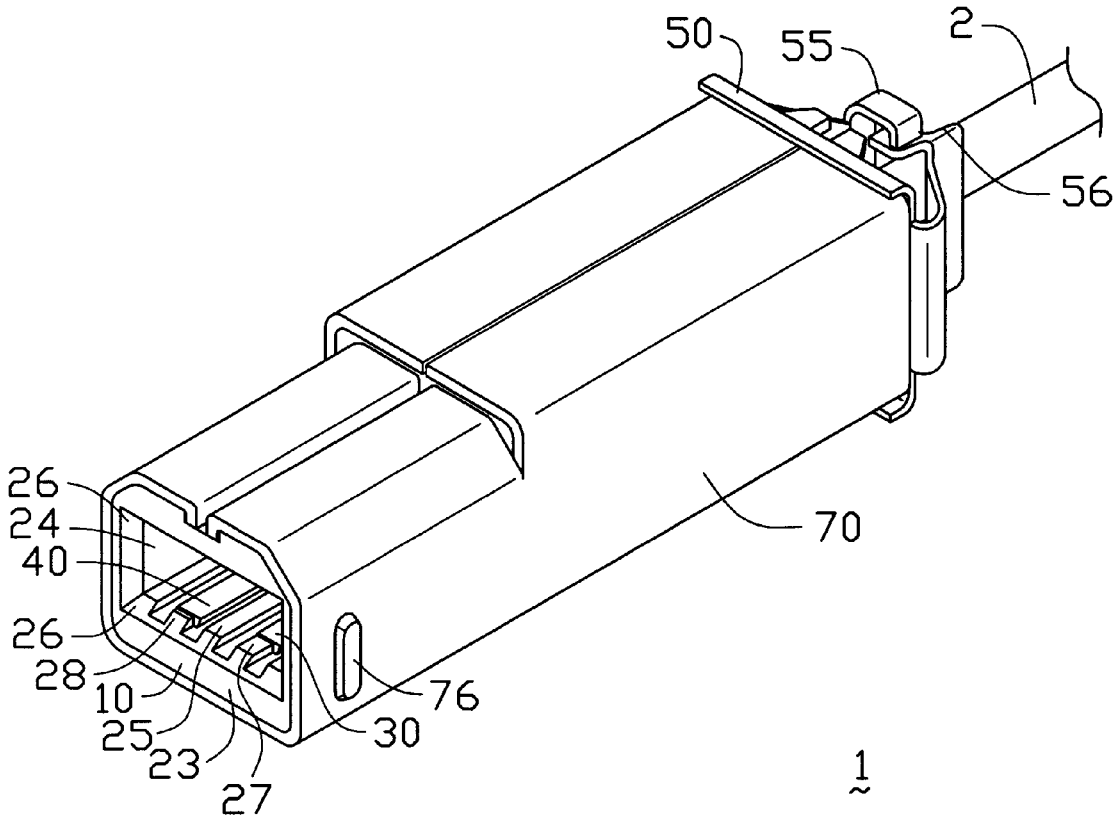
FIG. 10 shows another perspective view of the assembled USB connector shown in FIG. 9D.

FIG. 10 shows a rear perspective view of the present USB connector. Since the long and short protrusions 27, 28 are used to stop a tip of the long and short contacts 30, 40, respectively, the tip of the short contact 40 will be more adjacent to the rear surface 23 of the housing 10 than that of the long contact 30. When a mating connector is inserted into the cavity 24, the short contacts 40 will be engaged before the long contacts 30. Therefore, the short contacts 40 can be used as contacts for power supplying and the long contacts 30 can be used as contacts for signal transmission to meet the requirements of a user.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

I claim:

1. An electrical corrector (1), comprising:

an elongate insulating housing (10) including a plurality of first and second passageways (17, 18) extending longitudinally therein, a central cavity (24) recessed from a rear surface (23) thereof communicating with said first and second passageways (17, 18) for mating a mating electrical connector; and a plurality of first and second conductive contacts (30, 40) received in said first and second passageways (17, 18) and extending into said central cavity (24), each conductive contact (30, 40) consisting of a base plate (31) and a tail plate (32); wherein each of said first and second passageways (17, 18) includes an open space (14, 15) extending a depth from a front surface (29) of the insulating housing (10) toward the rear surface (23) of the insulating housing (10) and communicating with at least one adjacent open space (15, 14) and with the associated passageway (17, 18) to expose the tail plate (32) of each conductive contact (30, 40), the extending depths of said open spaces (14, 15) being different from each other for facilitating mounting of the conductive contacts into the passageways, and wherein each of said first and second passageways (17, 18) has a pair of lateral walls (8 & 16, 16 & 9) extending forward from a front face thereof, and said pair of lateral walls (8 & 16, 16 & 9) comprise a pair of lateral slot (19) formed on an inner surfaces thereof for guiding entering of the conductive contacts (30, 40) and restricting a longitudinal motion of said conductive contacts (30, 40) relative to the housing (10).

2. The electrical connector as claimed in claim 1, wherein said central cavity further comprises at least one separation wall raised from an inner lateral surface thereof for prevention of undesired conductive contacting between the conductive contacts.

3. The electrical connector as claimed in claim 1, wherein a wall is provided between each adjacent pair of the open spaces for at least partially separating said adjacent pair of open spaces.

4. The electrical connector as claimed in claim 1, wherein each of said cavity further comprises an annular chamfer surface adjacent to the rear surface to facilitate insertion of a mating electrical connector.

5. The electrical connector as claimed in claim 1, wherein said first conductive contacts are used for transmitting signals and said second conductive contacts are used for supplying power.

6. The electrical connector as claimed in claim 1, further comprising a metal shell surrounding said insulating housing for prevention of electromagnetic interference.

7. The electrical connector as claimed in claim 1, further comprising a metal cap mounted on a front end of said insulating housing for mechanically connecting with a cable.

8. An electrical connector (1), comprising an elongate insulating housing (10) including:

a plurality of first and second passageways (17, 18) extending longitudinally therein, a central cavity (24) recessed from a rear surface (23) thereof communicating said first and second passageways (17, 18) for mating a mating electrical connector; and a plurality of first and second conductive contacts (30, 40) received in said first and second passageways (17, 1 8), respectively, and extending into said central cavity (24); wherein each of said first and second passageways (17, 18) has a corresponding first and second protrusion (27, 28), respectively, formed on an inner lateral surface of the central cavity (24), said first and second protrusions (27, 28) extending a depth from said rear surface (23) of the insulative housing (10) and abutting tips of the conductive contacts (30, 40) extending into the central cavity (24), said first protrusion (27) extending a longer depth than said second protrusion (28) whereby said second conductive contacts (40) will be engaged with mating conductive contacts before said first conductive contacts (30) when a mating electrical connector is connected to said electrical connector (1), wherein each of said first and second passageways (17, 18)s a pair of lateral walls (8 & 16, 16 & 9) extending forward from a front face thereof, and said pair of lateral walls (8 & 16, 16 & 9) comprise a pair of lateral slots (19) formed on an inner surfaces thereof for guiding entering of the conductive contacts (30, 40) and restricting a longitudinal motion of said conductive contacts.(30, 40) relative to the housing (10).

9. The electrical connector as claimed in claim 8, wherein said central cavity further comprises at least one separation wall raised from an inner lateral surface thereof for prevention of undesired conductive contacting between the conductive contacts.

10. The electrical connector as claimed in claim 8, wherein a wall is provided between each adjacent pair of the open spaces for at least partially separating said adjacent pair of open spaces.

11. The electrical connector as claimed in claim 8, wherein each of said cavity further comprises an annular chamfer surface adjacent to the rear surface to facilitate insertion of a mating electrical connector.

12. The electrical connector as claimed in claim 8, wherein said first conductive contacts are used for transmitting signals and said second conductive contacts are used for supplying power.

13. The electrical connector as claimed in claim 8, further comprising a metal shell surrounding said insulating housing for prevention of electromagnetic interference.

14. The electrical connector as claimed in claim 8, further comprising a metal cap mounted on a front end of said insulating housing for mechanically connecting with a cable.

* * * * *